United States Patent [19]

Scholl et al.

[11] 4,056,709

[45] Nov. 1, 1977

[54] TAXIMETER INDICATOR ARRANGEMENT

[75] Inventors: Hans-Peter Scholl, Villingen-Schwenningen; Alfons Heimburger, Niedereschach; Ulrich Warkentin, Tannheim; Manfred Säufferer, Villingen, all of Germany

[73] Assignee: Kienzle Apparate GmbH, Villingen-Schwenningen, Germany

[21] Appl. No.: 587,235

[22] Filed: June 13, 1975

[30] Foreign Application Priority Data

June 14, 1974 Germany ..... 2428887

[51] Int. Cl.[2] ..... G07B 13/00

[52] U.S. Cl. ..... 235/30 R; 235/1 D; 235/45

[58] Field of Search ..... 58/50 R, 152 R, 152 B; 235/30, 33, 45, 1 D; 340/366 R, 366 A; 40/52 R, 77, 130 M

[56] References Cited

U.S. PATENT DOCUMENTS 3,698,627 10/1972 Kelch et al. ..... 235/30 R 3,822,547 7/1974 Fujita ..... 58/152 B 3,860,807 1/1975 Fichter et al. ..... 235/30 R

*Primary Examiner*—Robert K. Schaefer

*Assistant Examiner*—Vit W. Miska

*Attorney, Agent, or Firm*—Michael J. Striker

[57] ABSTRACT

A digital taximeter provides a visual read out of a first and a second multi-digit number. Instead of a plurality of discrete one-digit illuminated-digit display units arranged together to be capable of displaying multi-digit numbers, use is made of a single multi-digit illuminated-digit display unit having a row of equal-size digit zones. One or more of the middle ones of the digit zones are blocked from view to form a first and a second group of digit zones respectively adapted for the display of the first and the second multi-digit numbers and located to either side of the digit zones which are blocked from view. Although the digit zones are actually all of the same size, those of the first group are made to appear larger than those of the second group, in correspondence to the greater importance of the fare indication compared to the extra-charge indication.

9 Claims, 3 Drawing Figures

TAXIMETER INDICATOR ARRANGEMENT

BACKGROUND OF THE INVENTION

The invention relates to a two-part digital electronic indicator arrangement for taximeters of the type adapted to separately display the fare and extra charges.

Usually, taximeters are provided with two viewing windows. The digits indicating the taxi fare are visible through one of the windows, whereas the digits indicating the extra charges, if any, incurred during the trip are visible through the other of the windows. With conventional mechanical or electromechanical taximeters, larger digits were employed for the display of the taxi fare than for the display of the extra charges, in consideration of the fact that the fare is in general of greater interest to the passenger than is the amount of the extra charges. Accordingly, the digits indicating the amount of extra charges are usually relegated to digit-rolls, or the like, bearing smaller digits.

Particularly because the taximeter industry is turning more and more to electrical and electronic taximeters, increasing use is being made of electrical and electronic taximeter indicator arrangements for the taxi fare and for the amount of the extra charges. Additionally, the latter types of taximeter indicator arrangements have the advantage that they are highly visible in the dark, i.e., during trips at night, without, however, incurring the risk that the taxi driver may be momentarily blinded to some extent if he glances at the taximeter.

Electronic illuminated-digit tubes have been known for some time. With one known type, the numerals from "0" to "9" are arranged in one digit zone, one behind the other. This has the disadvantage that when the different numerals in one tube successively light up they appear at different distances from the viewing window, which can detract from the readability of the display, in addition to rendering non-uniform the appearance of a plurality of different numerals being simultaneously displayed using a plurality of illuminated-digit tubes for the display of a multi-digit number.

More recently, so-called 7-segment indicator tubes have been developed. These tubes are each comprised of seven segments so arranged that when all are simultaneously illuminated a rectangular figure "8" is formed. The other numerals are formed by simultaneously illuminating different combinations of the seven segments. This type of tube has the advantage that all the numerals which are displayed will appear at the same distance from the viewing window, i.e., in a fixed plane. However, a problem was involved in the display of multi-digit numbers. The only way to effect this display was to use a corresponding plurality of 7-segment indicator tubes. This is expensive.

Still more recently, cold-cathode gas-discharge indicator tubes have become common. With these, there are arranged in a single such tube a plurality of 7-segment display units arranged fixedly one next to the other. With these new multi-digit-zone iluminated-digit tubes, costs have been reduced, because only a single logical driving circuit is required for one multi-digit-zone tube.

However, these multi-digit-zone illuminated-digit tubes have not proved particularly advantageous for use in taximeter indicator arrangements. One problem is that all the 7-segment digit zones are of the same size, whereas for the reasons explained above it is preferred with taximeters to display different multi-digit numbers using digits of different size. Alternatively, if use is made of two separate multi-digit-zone illuminated-digit tubes, one for the display of one multi-digit number such as the taxi fare, the other for the display of the other multi-digit number such as the amount of the extra charges, then there arises the problem of driving two separate digit tube devices.

SUMMARY OF THE INVENTION

It is a general object of the invention to provide a taximeter indicator arrangement which can use a single multi-digit-zone illuminated-digit display device for the display of a plurality of multi-digit numbers, such as taxi fare and extra charges.

It is a further object to provide an indicator arrangement wherein the digits of one of the displayed numbers appear larger than those of the other of the displayed numbers, despite the fact that all the digit zones of the single multi-digit-zone illuminated-digit display device being used are actually of the same size.

It is another object of the invention to make possible the display of the different multi-digit numbers at locations on the taximeter substantially spaced from each other, despite the fact that the single multi-digit-zone illuminated-digit display device being used is comprised of a row of individual digit zones which directly adjoin one another.

These objects, and others which will become more understandable from the description, below, of a preferred embodiment, can be met, according to one advantageous concept of the invention, by using for the visual display of at least a first and a second multi-digit number on the face of a taximeter a single multi-digit-zone illuminated-digit display unit having a row of equal-size digit zones and including a first group of digit zones and a second group of digit zones respectively adapted for the display of the first and second multi-digit numbers. Resort is had to an optical expedient which creates the impression that the digit zones associated with the first multi-digit number are larger than the digit zones associated with the second multi-digit number. Whereas a variety of optical expedients could be employed, it is considered particularly simple and advantageous to frame the first and second groups of digit zones in respective first and second viewing frames so dimensioned and configured, for example having different breadths and being chamfered at different angles, as to create the optical and/or psychological impression of the digit zones of the first group being larger than those of the second group.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
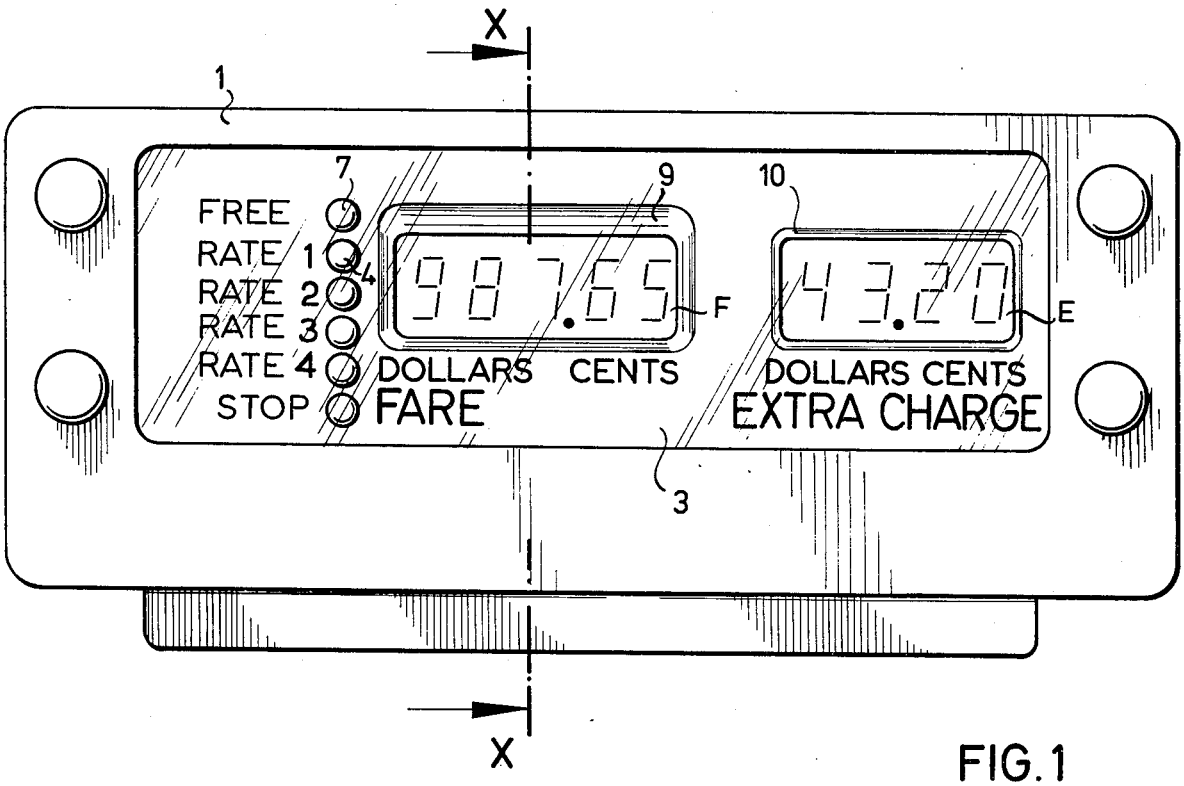
FIG. 1 is a front view of a taximeter according to the invention.
Figure 2:
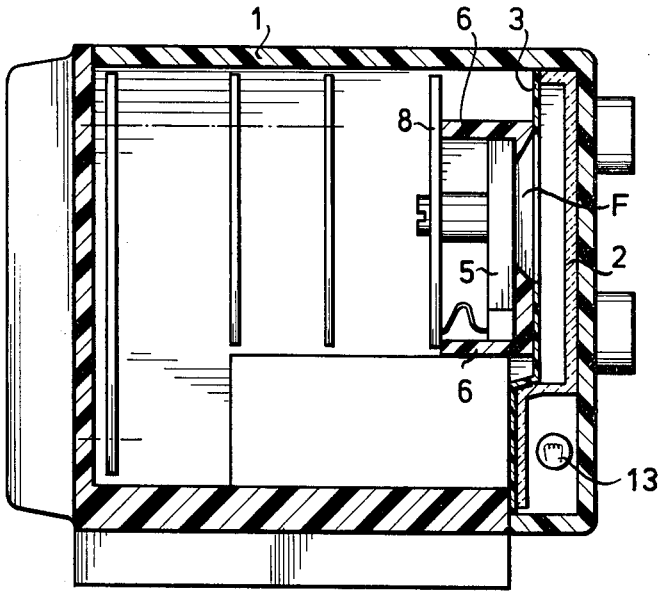
FIG. 2 is a section through the taximeter of FIG. 1, taken on line X—X.

In FIGS. 1 and 2, the front plate 1 of the taximeter is provided with a large glass viewing plate 2. Behind the glass viewing plate 2 there is arranged an indicia-bearing plate 3, visible through the viewing plate 2. The plate 3 bears various indicia, such as the indications "FARE" and "EXTRA CHARGE" respectively associated with the fare and extra-charge digit displays F and Z. The taximeter face is additionally provided with indicator lights 4 of which one is illuminated during taxi operation to indicate the manner of fare computation. The uppermost indicator light 4 lights up when the taxi is not occupied, i.e., FREE. The middle four indicator lights 4 are respectively associated with first, second, third and fourth fare computation rates. Depending upon such circumstances as time and location, the taxi driver sets the meter to one of these fare computation rates, and the corresponding indicator light 4 becomes illuminated. These different fare rates may be associated with factors such as the time of day, whether the trip is to be an in-town or out-of-town trip, or the number of passengers to be carried. The taxi driver also activates the meter for the indication of extra charges, such as many be associated with the carrying of luggage, children or domestic animals, the payment by the rider of bridge or tunnel tolls, and the like. For example, the taxi driver may repeatedly press a button on the taximeter for each 5¢ of additional charge until the indicated amount corresponds to a bridge toll which the driver has just paid. At the end of the trip, but before the passenger actually pays, the driver stops the meter, thereby preventing the indicated quantities from increasing further, but not terminating the display of the quantities; when the driver does this, the "STOP" light 4 will become illuminated. After the passenger has paid, the taxi driver sets the meter to "FREE". This causes the "FREE" light 4 to become illuminated, and effects resetting of the fare and extra-charge indications.

Before discussing the illustrated embodiment in further detail, a few general remarks are in order. The operation of a taximeter involves not only the computation of the fare and the registration of extra charges incurred, if any, but also the display of these quantities. The first tubes which became commercially available for the direct display of numerals were the so-called Nixie tubes. These contained a set of electrodes, including an anode and ten wire-like cathodes bent into the shapes of ten different numerals and respectively connected to different ones of ten electrical contacts. The bent-wire cathodes were arranged in parallel planes one behind the other. If a voltage is applied across the anode and one of the cathodes, then the respective cathode wire becomes covered over with a glow and the corresponding numeral becomes illuminated and visible through the glass bulb of the tube. The arrangement of the ten digit-electrodes one behind the other results, in the first place, in electrode overlap. The ranging of the numerals and their size are so selected that when the illuminated numeral is viewed in direction normal to the plane which it occupies it appears clear and sharp. However, when viewed at an angle to the normal direction, the illuminated numeral is much less legible. Also, as already mentioned, it is disadvantageous that the bent-wire cathodes are arranged in different planes, one behind the other, because different ones of the numerals will appear at different distances from the glass of the tube bulb, which can detrimentally affect legibility and detract from the uniformity of the appearance of the different numerals.

After Nixie tubes, 7-element tubes were developed which could be made to display different numerals from "0" to "9" be electrically connecting and disconnecting different ones of the seven elements. Such 7-element tubes have the advantage that the illuminated numerals are clearly legible even when viewed at a certain angle relative to the normal direction. Additionally, the various illuminated numerals all appear in the same plane, namely the plane of the seven elements, and accordingly always appear at the same distance from a stationary viewer. However, difficulties arise when a multidigit number is to be displayed. A plurality of 7-element tubes tends to be rather space-consuming; and room must be found for the various wires connected to the tubes and for the driving circuitry. A very considerable difficulty may be constituted by the problem of accurately aligning and positioning the plurality of tubes so that the multidigit numbers displayed have a neat and uniform arrangement. Each individual 7-segment indicator tube requires nine electrical connections, in order to make possible display of the numerals "0" to "9". Additionally, when a plurality of individual 7 -segment indicator tubes are employed the expense for the logical driving circuitry which must be provided for each tube tends to be considerable. In order to facilitate and improve the proper relative positioning of a plurality of such tubes for the display of multi-digit numbers, it is known to combine two or three such tubes to form a single block. Nevertheless, each 7-segment digit zone requires nine electrical connections with such arrangements.

More recently, so-called numerical front-plate display units have appeared on the market. This type of illuminated-digit display unit is comprised of a plurality of digit zones in a common tube bulb. The unit is designed for parallel operation, resulting in a considerable simplification of the logic circuitry necessary for operating the unit. Furthermore, these new frontplate display units are legible when viewed at an angle of up to 120° and require fewer than two electrical connections per digit zone. The proper positioning of the digit zone relative to each other is performed by the manufacturer at the time of manufacture. These tubes, of generally rectangular plate-shaped configuration, are perfectly flat at the side thereof at which the indications appear. Such front-plate display units are currently available as 8-digit-zone, 11-digit-zone and 16-digit-zone units, and even as units with greater numbers of digit zones. They operate as cold-cathode gas-discharge tubes.

In the illustrated embodiment the taximeter employs for the display of both the taxi fare and the amount of extra charges a single front-plate display unit 5 of the type just discussed. As shown in FIG. 1, the taximeter in question has a five-digit-zone display F for the taxi fare and a four-digit-zone display Z for the extra charges. For this reason, use is made of an eleven-digit-zone front-plate display unit 5 for the display of both multi-digit numbers. The two middle digit zones, between the lowest-value digit zone of display F and the highest-value digit zone of display Z, are not used, and are covered over so that their existence will not be in evidence to the viewer. Accordingly, the elements of these two digit zones need not be electrically connected to the electronic logic circuitry of the taximeter.

Figure 3:
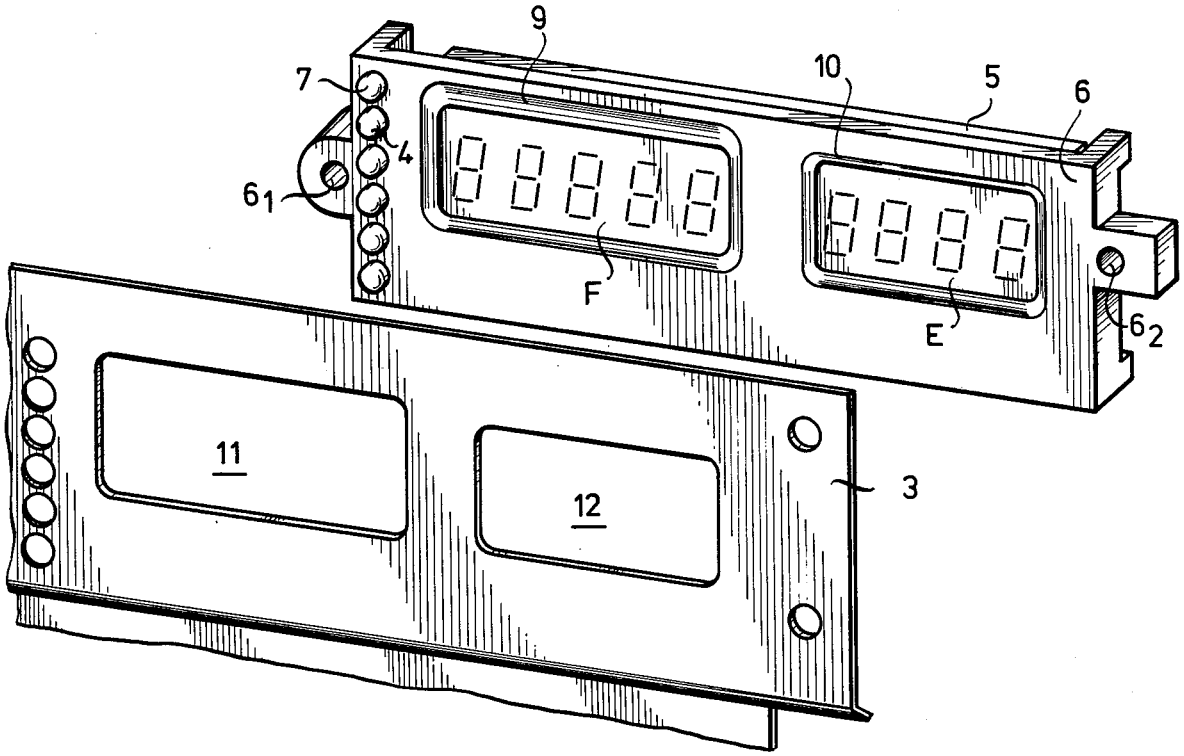
FIG. 3 is an exploded perspective view of the taximeter.

As seen in FIG. 2, the display unit 5 is held in place by a mask 6 which surrounds and holds the display unit 5 somewhat like a picture frame. The mask 6 is provided with apertures 7 which serve to hold the indicator lights 4. The mask 6, supporting the display unit 5, is in turn by means of two screws supported on a mounting plate 8 of the taximeter, further details of which are not illustrated or described. In this way there is simultaneously achieved a reliable holding and positioning of the indicator lights 4, which are preferably light-emitting diodes. Using the mask 6 and the two mounting screws reaching through holes $6_1$ and $6_2$ (FIG. 3) to the mounting plate 8 there is achieved a particularly simple and reliable mounting for the multi-digit display unit 5 and the indicator lights 4 such as has not been achieved before.

The mask 6 serves purposes besides the mounting and positioning functin just described. The mask 6 is provided with two viewing frames 9 and 10, the taxi fare display F being viewable through frame 9 and the extra charge display Z being viewable through frame 10. The viewing frame 9 is larger (of greater breadth) than the viewing frame 10. On the one hand the opening for the frame 9 is larger on all sides than is that for the frame 10. In addition, the rim profiles of the two viewing frames are different, i.e., the various chamfers are inclined at different angles, so that the frame 9 makes each of the five digit zones viewed therethrough appear larger than digit zones viewed through the frame 10. These two structural features contribute to the creation of an impression of greater size of the digit zones in frame 9 which, for the purpose in question, is as effective as the use of optical magnifying means, or the like, and which is evidently considerably less expensive. Specifically, in the case of the viewing frame 9 the chamfer makes a large angle relative to a normal to the plane of the indication, being inclined relatively flat relative to the surroundings face of the mask 6. In contrast, the viewing frame 10 makes a relatively small angle with respect to a normal to the plane of the indication. Accordingly, there is created additionally the impression that the opening of the viewing frame 9 is larger than that of the viewing frame 10. Because the illuminated digits of illuminated-digit display units appear particularly bright when displayed against a dark background, the mask 6 is advantageously made of black synthetic plastic material. The flatter chamfer of the viewing frame 9 makes the surrounding dark portion seem larger, with the result that the numerals appearing in the digit zones of the display F seem larger and brighter than those of the display Z.

The contrast effect is further increased in the illustrated embodiment if the indicia-bearing plate 3 on its front side is made a bright color, preferably bright yellow. An aperture 11 in the plate 3 surrounds the dark viewing frame 9 of the mask 6, whereas an aperture 12 surrounds the frame 10 of the mask. As can be seen in the drawing, the size difference of the apertures 11 and 12 serves to markedly increase the visual prominence of the display F compared to the display Z. In the illustrated embodiment, the indicia-bearing plate 3 is illuminated from below by electric lamps 13; alternatively the lighting could be from the sides.

Accordingly, the passenger is able to easily and comfortably read off the displays of taxi fare and extra charges, without the need to employ two separate independent multi-digit-zone display units displaying numerals of different size. This important advantage is achieved despite the fact that there is used for the two displays a single shared multi-digit-zone indicator tube which, in turn, because of the way in which it is designed makes possible an extremly important decrease of the complexity of the requisite electronic control circuitry and accordingly of the cost.

It will be understood that each of the elements described above, or two or more together, may also find a useful application in other types of circuits and constructions differing from the types described above.

While the invention has been illustrated and described as embodied in a taximeter in which two quantities are displayed by means of illuminated-digit display means, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a digital taximeter of the type operative for providing a visual read out of at least a first and a second multi-digit number, in combination, a single multi-digit illuminated-digit display unit having a row of equal-size digit zones and including a frist group of digit zones and a second group of digit zones respectively adapted for the display of the first and second multi-digit numbers;

blocking means for blocking from view at least one of the middle digit zones of said single multidigit illuminated-digit display unit to thereby form said first and second groups of digit zones located to either side of the digit zones which are blocked from view, said blocking means including first and second viewing frame means respectively framing said first and second groups of digit zones, said first viewing frame means being configured and dimensioned differently from said second viewing frame means for making the digit zones of said first group appear larger than the digit zones of said second group.

2. In a digital taximeter as defined in claim 1 wherein said blocking means first and second viewing frame means are parts of a single one-piece member.

3. In a digital taximeter as defined in claim 1, wherein said first and second frame means are both chamfered, and wherein said first and second frame means are differently chamfered with such respective chamfer angles as to cause the digit zones of said first group to appear larger than the digit zones of said second group.

4. In a digital taximeter as defined in claim 1, wherein the digit zones which are blocked from view are unused digit zones having electrical contacts which are electrically unconnected to the remainder of the taximeter.

5. In a digital taximeter as defined in claim 2, wherein said single member is a generally flat mask member, and wherein a first portion and a second portion of said mask member respectively form said first and second viewing frame means, and wherein said first and second portions are of different breadth to make the digit zones of said first group appear larger than the digit zones of said second group.

6. In a digital taximeter as defined in claim 10, further including an indicia-bearing plate covering said generally flat mask member and provided with first and second apertures in register with said first and second viewing frame means and dimensioned so that said first and second groups of digit zones and also said first and second viewing frame means are visible through said first and second apertures.

7. In a digital taximeter as defined in claim 5, wherein said member is configured as a holding member, and wherein said illuminated-digit display unit is held in place by said member.

8. In a digital taximeter as defined in claim 6, the taximeter being additonally provided with taximeter control buttons for controlling taximeter operations and with a plurality of indicator lights for indicating which taximeter control button has been activated, and wherein said indicia-bearing plate is provided with a plurality of apertures respectively in register with said indicator lights and through which said indicator lights are viewable, said taximeter control buttons being located outside the area of said indicia-bearing plate.

9. In a digital taximeter as defined in claim 6, wherein at least the portions of said indicia-bearing plate which surround said apertures therein are of a first color, and wherein said frames visible through said apertures are of a second color which is darker than and in contrast to said first color.

* * * * *